United States Patent [19]

Wagner

[11] 4,160,525

[45] Jul. 10, 1979

[54] SPRAY GUN CONSTRUCTION

[75] Inventor: Josef Wagner, Friedrichshafen, Fed. Rep. of Germany

[73] Assignee: Firma Josef Wagner GmbH, Fed. Rep. of Germany

[21] Appl. No.: 853,348

[22] Filed: Nov. 21, 1977

[30] Foreign Application Priority Data

Nov. 27, 1976 [DE] Fed. Rep. of Germany ..... 2653981

[51] Int. Cl.[2] ..... B05B 9/043

[52] U.S. Cl. ..... 239/332; 222/333

[58] Field of Search ..... 239/332, 600; 222/333

[56] References Cited

U.S. PATENT DOCUMENTS

| | | | |
|---|---|---|---|
| 2,410,692 | 11/1946 | Strobell | 239/332 |
| 2,704,690 | 3/1955 | Eichenauer | 239/332 X |
| 3,116,879 | 1/1964 | Wagner | 239/332 |
| 3,445,068 | 5/1969 | Wagner | 239/332 |
| 3,899,134 | 8/1975 | Wagner | 239/332 |

*Primary Examiner*—Johnny D. Cherry

*Attorney, Agent, or Firm*—McGlew and Tuttle

[57] ABSTRACT

A spray gun construction, comprises a housing part which is interconnected with a container part at its front end and a handle part at its rear end which has an actuating button. The housing part has a suction bore and a return bore located in fixed spaced apart relationship and a spray nozzle and surge chamber member which has a suction line connection which extends into the spray bore and a return line connection which extends into the return bore which alone or in combination with other pin and peg arrangements permit interconnection and alignment of the nozzle with the associated surge chamber on the housing in connection with a container or reservoir member containing the liquid to be sprayed. In addition, a U-shaped bridge member is pin- or peg-connected into the first housing to the rear of the spray nozzle and surge chamber member and it carries an electromagnetic pump which includes a coil portion mounted on the bridge member with an armature which is pivoted on the coil portion and actuates a piston member which is mounted for sliding movement on the bridge member so that the piston thereof moves backwardly and forwardly in the surge chamber.

9 Claims, 7 Drawing Figures

SPRAY GUN CONSTRUCTION

FIELD AND BACKGROUND OF THE INVENTION

This invention relates in general to liquid spray devices and, in particular, to a new and useful spray gun for atomizing liquids by means of a piston pump having an AC-oscillator magnet-driven piston which is inserted in a cylinder which is in turn arranged in a separate, interchangeable pump housing.

DESCRIPTION OF THE PRIOR ART

With the known spray guns, the pump housing is locked or screwed into a gun housing which is made of a synthetic material or of a cast metal. While these improvements have a record of reliability, the prior constructions have considerable drawbacks. For example, regardless of its economical production potential with a synthetic material made gun housing, undesirable elasticity effects are frequently produced because the synthetic material breathes. This has a detrimental dislocating effect on the exact interaction of drive components, which rules out trouble-free operation of the gun. The effectiveness and quality of liquid atomization is adversely affected by the constant-changing tolerances and a disturbing noise is generated.

With a die cast gun housing, such elasticity effects are eliminated to a large extent. However, the manufacture of the housing is connected with extremely high production expenditures, namely, the machining of each bearing and limit stop must be done accurate-to-gauge so that the drive components cooperate in a precise manner. Additionally, because the stator is rigid-riveted to the gun housing and the die cast component cannot be deformed, any gauge inaccuracies cannot be fixed retroactively. Economic production of spray guns having a die cast gun housing is thus impossible because of the expensive manufacture of the die cast component.

SUMMARY OF THE INVENTION

The present invention provides a spray gun for the atomizing of liquids by means of a piston pump which has a piston which is driven by an AC-oscillator magnet inserted in a cylinder and which is arranged in a separate, interchangeable pump housing. The invention provides a gun housing made of a synthetic material which nevertheless permits an exact coordination of drive components without any operational elasticity effects. Any play under load effective in the drive components will thus be reliably eliminated. Furthermore, the production and assembly input will be minimized so that economic manufacture is ensured for large scale series-production as well.

According to the invention, this problem is solved by providing a completely or partially U-shaped sheet metal bridge for holding the pump housing, which accommodates the stator of an AC-oscillator magnet approximately at its center between both of its legs projecting from their interconnecting base plate. The magnet connected to the legs by machining one or more bores or limit stops into the frontal part of a baseplate of the sheet metal bridge is for the purpose of arresting the pump housing by means of screws, pins, or peglike projections or the like, and by attaching backwardly protruding opposed lugs to the sheet metal bridge legs to accommodate the regulator screw which controls the armature of the AC-oscillator magnet.

To obtain better results, a rigid connection is established between the stator of the AC-oscillator magnet and the sheet metal bridge by bolting one or several rivets, screws or dowel pins through both sheet metal bridge legs or by welding the legs onto the stator plates and, in any given case, by outward bending of the sheet metal bridge legs for accommodating and anchoring the stator.

Of further advantage is the machining of one or more recesses into the base plate of the sheet metal bridge for conducting a pump housing connected suction and/or runback line, whereby, these recesses can be developed as locking bores and the pump housing is equipped with locking pins engaging the former.

It is also of practical advantage to machine into the sheet metal bridge baseplate, one or more slots, preferably open toward the front for a lateral locking of the pump housing, and to attach one or more laterally outwardly projecting bendoffs to the baseplate legs, which engage the gun housing pockets. One or more slots preferably open toward the front for a lateral locking of the pump housing, and to attach one or more laterally outwardly projecting bendoffs to the baseplate legs, which engage the gun housing pockets for locking the sheet metal bridge into the gun housing.

Furthermore, to hold the regulator screw, the bridge leg attached lugs are each provided with a recess, which engages a regulator screw-accommodating adapter, which is preferably made of a synthetic material. It is also feasible to bend the lugs in a ring-segmental manner and to provide them on their inner surface with a thread for holding the regulator screw.

The spray gun design according to the invention produces an extremely rigid mount for all drive elements so that their association is unchanged even under operational conditions, and a trouble-free gun operation is insured for a long period of time. If for pump housing mounting purposes, a U-shaped sheet metal bridge is provided between which legs the stator of an AC-oscillator magnet is rigidly arranged, and in which frontal area, a pump housing is attached to the baseplate, and in which rear area a regulator screw is held by attached lugs then, on said sheet metal bridge and, thus, on a single part, all interacting drive components are carried. In this case, the pump housing with inserted cylinder and piston is exactly aligned with the stator and the anchor which is actuated by it, and the regulator screw is aligned with the latter. The gun housing itself thus has no effect on the spray gun drive components, so that it can be economically manufactured from any synthetic material without any repercussions.

Because singular parts are applicably rigid-connected or locked into the sheet metal bridge, any type of tolerances produced under load is also eliminated, so that any pertinent noise conditions and effectivity losses are guaranteed to be avoided. Moreover, the quality of liquid atomization remains constant on any given interchange of the pump unit and the pump position is always set exactly the same because of the locking provisions.

The design and production input required for accomplishing this is extremely low, namely, the bridge can be punched out from sheet metal and finished by canting it off without any post-machining work. In addition, the assembly of the spray gun is very simple, because after the attaching of the sheet metal bridge to the stator in both, gun and pump housing, plus the regulator screw, can be easily attached to the bridge. Thus, the design developed according to the invention allows for an economic production of spray guns and affects their operation in a very favorable manner.

Accordingly, it is an object of the invention to provide a spray gun which includes a housing part which has a suction bore and a return bore rearwardly of the suction bore and includes a U-shaped bridge member engageable on the housing part which has first and second spaced apart leg portions and a base portion connected to the leg portions and which also includes a spray nozzle and surge chamber member which is engageable on the housing part in front of the bridge member which includes a spray nozzle part and a surge chamber part which has a suction line portion engaged through said suction bore and a return line portion engageable with the return line bore and further including an electromagnetic pump which has a coil portion connected to and supported in the bridge member between the leg portions and a piston portion which is disposed with a piston part in the surge chamber and which includes an armature pivoted on the coil portion and engageable with the piston portion to advance it to move liquid taken into the surge chamber from the suction line out through the nozzle, the armature being returnable by a spring and, wherein, each of the housing part and the bridge member, and the spray nozzle and surge chamber member, have interengageable pin or peg means and recesses for interconnecting them together in aligned positions.

A further object of the invention is to provide a spray gun construction which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
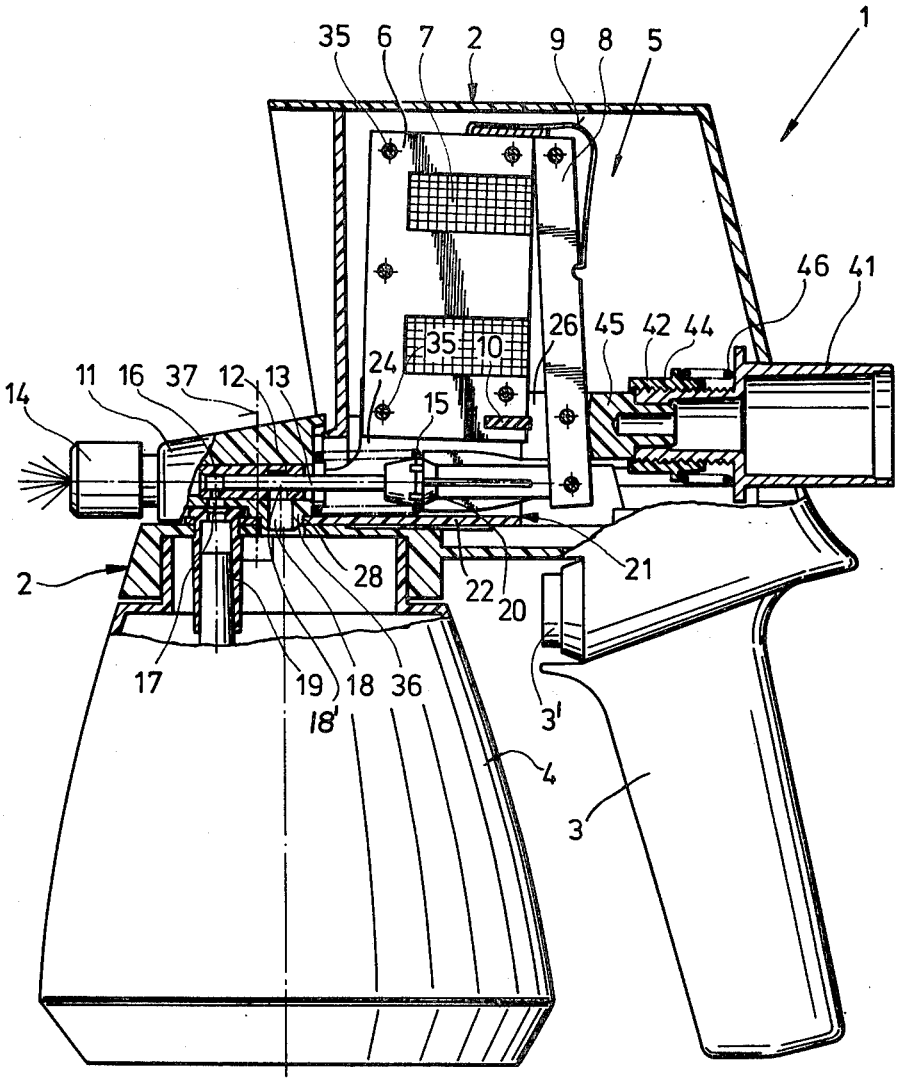
FIG. 1 is a partial elevational and longitudinal sectional view of a spray gun constructed in accordance with the invention.

Referring to the drawings in particular, the invention embodied therein in FIG. 1, comprises a spray gun 1 for the atomizing of liquids which includes an AC-oscillator magnet 5 inserted in a synthetic material housing 2, and a pump piston 13 arranged in a cylinder 12 and driven by an armature 8 of AC-oscillator magnet 5, by which the liquid to be atomized is drawn out of a container 4 and is ejected by a nozzle 14 in known fashion. Nozzle 14 has a known bore therethrough which communicates with a chamber 16. An actuator button 3' is built into a handle 3 which is attached to gun housing 2. Magnet coil 7 of a stator 6 is connected to an electric exciting circuit by actuating button 3'. Button 3' is a switch connected to coil 7, comprising means on the housing for energizing the coil 7. Because of the magnetic field produced, armature 8, pivoted on the stator 6, is pulled against the force of a restoring spring 15 by the supporting force of an L-shaped retainer spring 9. Armature 8 acts upon a spring plate 20 which is rigidly connected to pump piston 13. The liquid located in surge chamber 16 is thus ejected by the armature 8 from nozzle 14 through the shifting of piston 13 to the left and the liquid is atomized in the process in known fashion. When armature 8 moves to the right in FIG. 1, in accordance with one half oscillation of a.c. oscillator magnet 5, piston 13 moves to the right, drawing liquid into chamber 16 by suction in known fashion. The return of piston 13 is accomplished by the compression of spring 15 which is anchored between pump housing 11 and base plate 20. Liquid is drawn from the container 4 and directly into the surge chamber 16 by a suction line 17. Some of the liquid may be discharged through a slot 18' between cylinder 12 and piston 13 and can flow back into container 4 via return bore 18.

A U-shaped bridge 21 made of sheet metal is used for the attachment of the AC-oscillator magnet 5 of pump housing 11, as well as a regulator 41, by means of which the stroke of the armature 8 can be set. Thus, the spacing between the regulator 41 accommodating bridge 21 part and the armature 8 is set as exactly and permanently as is the spacing between stator 6 and pump housing 11.

Figure 2:
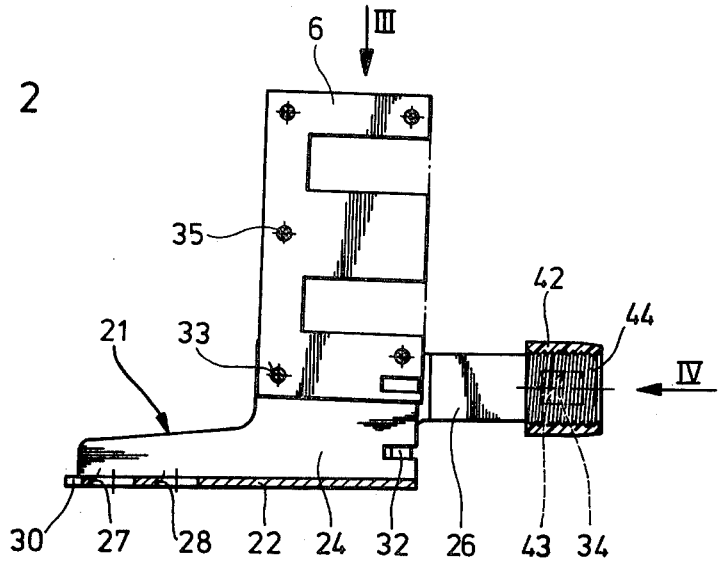
FIG. 2 is a partial longitudinal sectional view of the bridge which is connected to the stator of the electromagnet pump.
Figure 3:
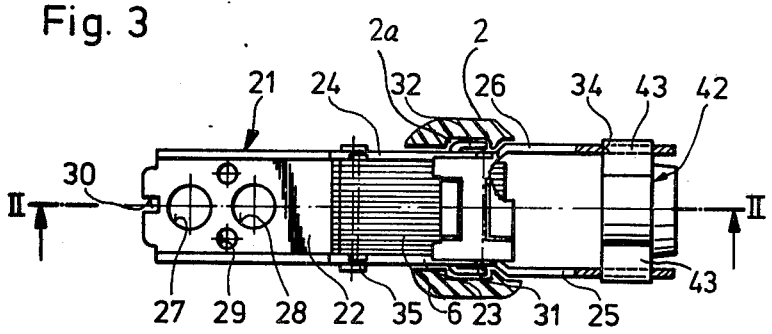
FIG. 3 is a top view of the bridge shown in FIG. 2.
Figure 4:
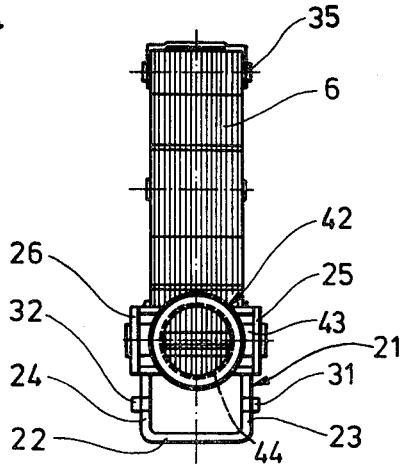
FIG. 4 is a rear elevational view of the bridge shown in FIG. 2.

As can be seen in more detail in FIGS. 2, 3 and 4, the U-shaped sheet metal bridge 21 comprises a baseplate 22 and two legs 23 and 24 which are rectangularly angled off of the bridge, between which the stator 6 is inserted. The rigid connection of stator 6 with sheet metal bridge 21 is accomplished by rivets 33 which pass through bores of the stator plates and the legs 23 and 24. It is, of course, also feasible to weld the legs 23 and 24 to the stator 6 or screw them into it, rather than to provide a rivet connection.

Bores 27, 28 and 29 are machined into baseplate 22 to mount and attach a pump housing 11 which is equipped with a lateral peg-like nose 36 which engages into a retention bore 28, so that an exact interlocking of these parts is accomplished. By means of screws of which centerlines are indicated at 37 and which extend through bores 29, the pump housing 11 is attached to bridge 21. For a lateral positional fix of pump housing 11, a slit 30 is additionally punched into baseplate 22 in which said housing is held, by means of a nose-like projection.

Prior to setting up pump housing 11 on bridge 21, the gun housing 2 is first connected to the pump housing. For this purpose, a suction pipe nipple 19 is used, which is stuck into bore 27 and clamped into the frontal part of gun housing 2. Furthermore, outward angling bendoffs 31 and 32 are laterally attached to legs 23 and 24 to be locked into pockets 2*a* of gun housing 2 shown in fragmentary parts in FIG. 3, so that the gun housing is also held laterally on bridge 21.

The regulator 41 is held by lugs 25 and 26 attached to the legs 23 and 24, respectively. For this purpose, lugs 25 and 26 are advantageously provided with a recess 34 which locks into an adapter 42 made of a synthetic material and having noses 43. The regulator 41 which has a free end with a rubber damper 45 is screwed into a threaded part 44 of adapter 42. Thus, by rotating regulator 41 against the force of prestressing spring 46, which prevents any self-acting operational shift, the stroke of armature 8 can be infinite-variable changed. A rubber disc 10 inserted into stator 6 damps any impact produced noise.

Thus, all of the spray gun 1 key parts are exactly fixed in their mutual position. Because of this configuration, no elasticity effects are produced in operation, so that a trouble-free operation is ensured for a long period of time.

Figure 5:
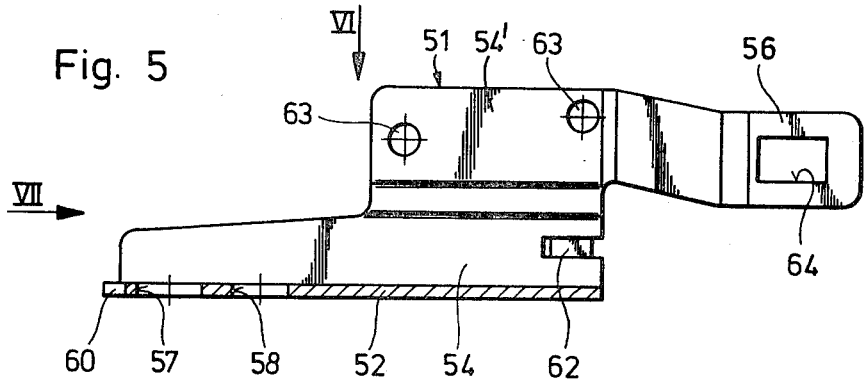
FIG. 5 is a view similar to FIG. 2 of another embodiment of the invention.
Figure 6:
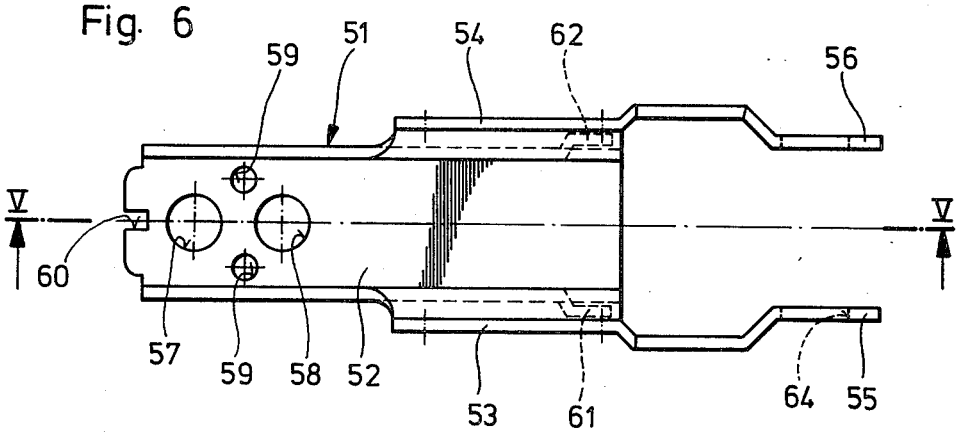
FIG. 6 is a top view of the bridge shown in FIG. 5.
Figure 7:
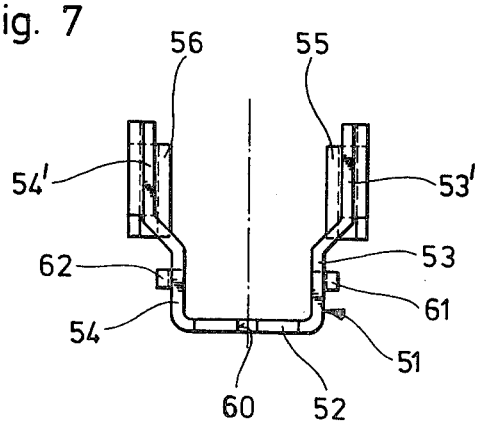
FIG. 7 is a front view of the bridge shown in FIG. 5.

The bridge 51, shown in FIGS. 5, 6 and 7, is produced equally from a baseplate 52 and U-shaped bent legs 53 and 54. The legs 53 and 54 have bores 63 for the riveting or screwing-in of a stator, and they are outwardly canted in their upper areas 53' and 54' for accommodating the stator 6 which is wider than the clearance between legs 53 and 54. Furthermore, lugs 55 and 56 which are each provided with a recess 64 are secured to the stator 6 for holding a regulator screw.

The attachment of the pump housing is accomplished in the same manner as in the embodiment according to FIG. 1, by means of baseplate 52 machined-in bores 57, 58 and 59, and by means of slot 60, into which said housing is guided by means of a nose. In addition, to hold bridge 51 in the gun housing, there are laterally outwardly projecting bendoffs 61 and 62 attached to legs 53 and 54, which engage the pockets of the gun housing.

While specific embodiments of the invention have been shown and described in detail to illustrate the application of the principles of the invention, it will be understood that the invention may be embodied otherwise without departing from such principles.

What is claimed is:

1. A spray gun for spraying liquid comprising a housing part having a suction bore and a return bore positioned rearwardly of said suction bore, a sheet metal U-shaped bridge member engageable on said housing part having first and second spaced apart leg portions and a base portion connected between said leg portions and engageable on said housing part, a spray nozzle and surge chamber member in front of said bridge member having a suction line portion engaged through the suction bore for drawing liquid into said chamber member and a return line portion engaged through the return bore, an electromagnetic pump having a coil portion connected to and supported in said bridge member on said base portion between said leg portions, a piston portion disposed with a piston part in said surge chamber of said spray nozzle and surge chamber member and an armature pivoted on said coil portion and engageable with said piston portion to advance it to move liquid taken into said surge chamber from said suction line portion out through said nozzle, means on said housing part for energizing said coil portion to move said armature, spring means biasing said armature in a return direction away from the direction of movement affected by said armature to move said armature to a return position, each of said housing part and said bridge member and said spray nozzle and surge chamber member having interengageable pin and recess means for interconnecting them together in aligned and fixed relative positions.

2. A spray gun construction, according to claim 1, including a regulator member engageable with said bridge member engaged in said armature and having an adjustment stop threaded member and a second threaded member engageable with said adjustment stop threaded member, the adjustment stop threaded member being positionable in alignment with said armature in accordance with the amount of threaded engagement with said second threaded member to limit the return movement of said armature.

3. A spray gun construction, according to claim 1, wherein said bridge member first and second leg portions are canted outwardly for accommodating the coil portion of said electromagnetic pump.

4. A spray gun construction, according to claim 1, wherein said base portion of said U-shaped bridge member includes the return bore for receiving return line connection of said spray nozzle and said surge chamber member, said suction line and said return line connection comprising pegs engageable into recesses of said bridge member and said housing part.

5. A spray gun construction, according to claim 1, wherein said U-shaped bridge member base portion has at least one slot open at its front end for the lateral locking of said bridge member to said housing part and to said spray nozzle and surge chamber member.

6. A spray gun construction, according to claim 1, wherein said bridge member includes outwardly projecting bentoff portions, said housing part having receiving pockets into which said bentoff portions are engaged for locking the parts in position.

7. A spray gun construction, according to claim 1, wherein said U-shaped bridge member has a recess, and including a regulator engaged in said recess and having a member which may be adjusted to define a stop adjacent said armature.

8. A spray gun construction, according to claim 1, wherein said U-shaped member includes lug portions on said leg portions which include a recess, an adapter having nose portions inserted into said recess of said leg portions and having a part provided on its inner surface with a screw thread, and including a regulator having a regulating screw part threaded to said screw thread and a portion engageable with said armature for adjusting the movement of said armature.

9. A spray gun construction, according to claim 1, including a container engaged with said housing part adjacent said spray nozzle, said suction line portion extending into said container, a handle portion connected to said housing part to the rear of said container and an actuator button carried on said handle portion connected to said coil portion for actuating said coil portion.

* * * * *